US006196424B1

(12) United States Patent
Bougamont et al.

(10) Patent No.: US 6,196,424 B1
(45) Date of Patent: Mar. 6, 2001

(54) ARTICULATED PISTON PUMP

(75) Inventors: Jean-Louis Bougamont, Eu; Hervé Lompech, Incheville; Pierre Dumont, Eu, all of (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/423,657

(22) PCT Filed: May 28, 1998

(86) PCT No.: PCT/FR98/01062

§ 371 Date: Nov. 22, 1999

§ 102(e) Date: Nov. 22, 1999

(87) PCT Pub. No.: WO98/53917

PCT Pub. Date: Dec. 3, 1998

(30) Foreign Application Priority Data

May 29, 1997 (FR) ..... 97 06586

(51) Int. Cl.[7] ..... B65D 88/54
(52) U.S. Cl. ..... 222/321.9
(58) Field of Search ..... 222/340, 321.9, 222/385; 417/550

(56) References Cited

U.S. PATENT DOCUMENTS 3,954,354 * 5/1976 Boris ..... 417/550

5,271,532 * 12/1993 Jumel et al. ..... 222/321.9

* cited by examiner

*Primary Examiner*—Philippe Derakshani
(74) *Attorney, Agent, or Firm*—Bacon & Thomas, PLLC

(57) ABSTRACT

The invention concerns a pump comprising a substantially cylindrical body (1) defining internally a metering chamber (11) whereof the lower end (1*a*) is provided with an intake orifice (10) equipped with a valve (12) and the upper end is provided with an outlet (20*a*) and closed by a piston (2) capable of moving in said chamber (11) by cooperating with elastic return means (4) outside the chamber (11), between a support up stop and a limit down stop. Said piston (2) comprises a central core (21) integral with the bottom end (23*a*) of a hollow axial rod (23) whereof the top end (23*b*) projects outside the metering chamber (11) and a coaxial sleeve (22), connected to said rod (23) by an elastic articulation (24) ensuring a sealed contact with the chamber (11) internal wall and defining with said core (21) a ring-shaped evacuating conduit (20) capable of being opened by displacement of said sleeve (22) with respect to the core (21), and the pump body (1) upper part being closed by a flange (3) whereof the internal surface forms the piston (2) up stop and the external surface serves as bottom support for the elastic return means (4). Said flange (3) is provided with an axial bore (30) wherein moves the hollow rod (23) integral with the piston. The invention is characterized in that said sleeve comprises a top ring (22*b*) designed to be urged into sealed engagement in a peripheral groove (31) arranged in said flange (3) internal surface.

14 Claims, 6 Drawing Sheets

ARTICULATED PISTON PUMP

Figure 1:
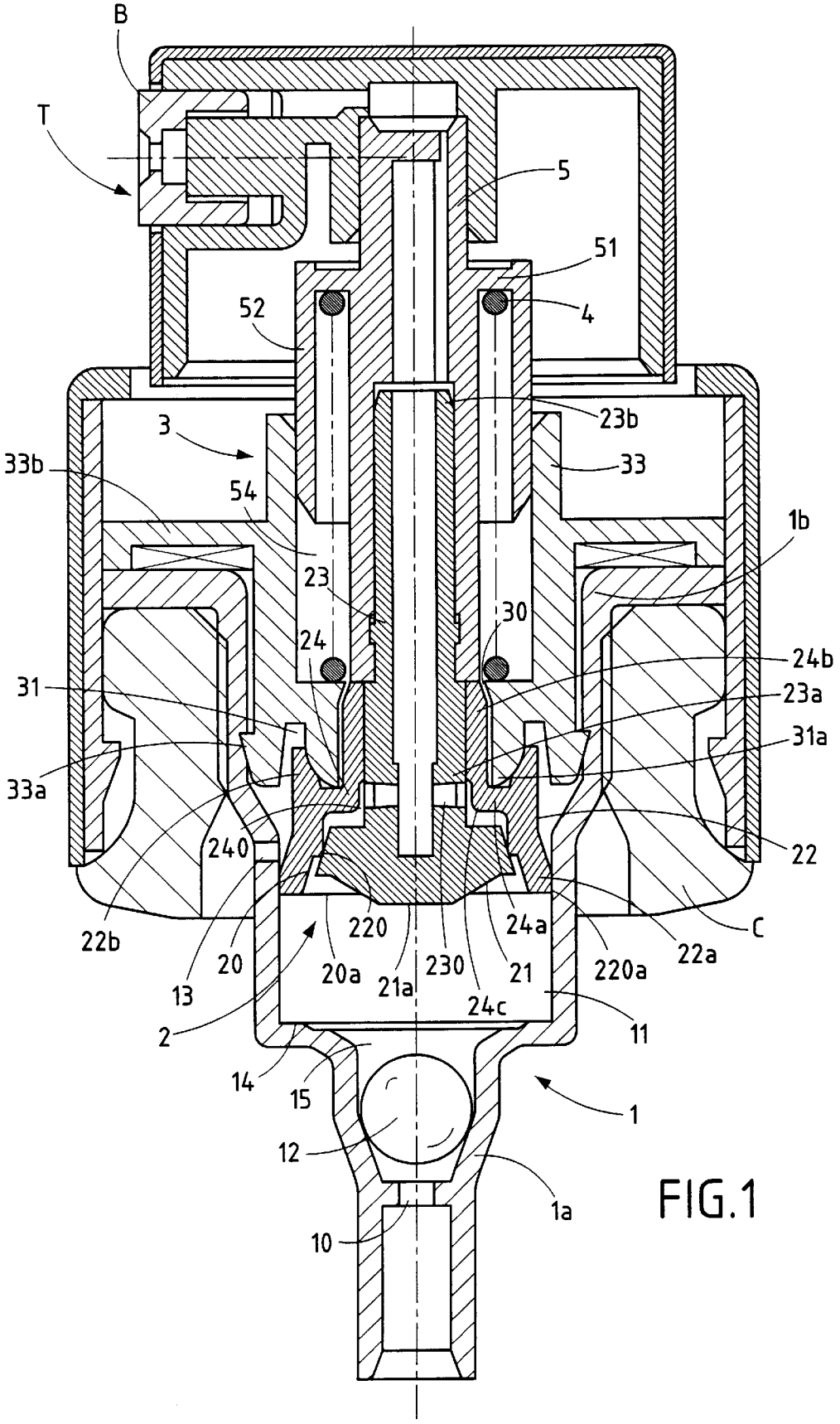

The present invention relates to a pump and more precisely a pump for delivery in atomized form of perfumes or cosmetic products or of small doses of pharmaceutical products.

Pumps exist, comprising a substantially cylindrical body intended to be fixed on a recipient and internally defining a chamber for metering the product to be dispensed. The lower end of the body is provided with an intake orifice equipped with a valve and its upper end is, on the one hand, provided with an outlet orifice and is, on the other hand, closed by a piston. This piston is capable of moving in the metering chamber, cooperating with elastic return means, between a support up stop and an end-of-stroke down stop.

At priming, the first descent of the piston drives out air then its rise causes the metering chamber to be filled with the product.

The following displacements of the piston are accompanied, at descent, by an atomization of product to the outside, via the outlet orifice, under the effect of the hydraulic pressure, and, at rise, by a suction of product in the chamber via the intake orifice.

However, heretofore known pumps present a larger number of parts and assembly thereof necessitates complex and delicate operations, in particular for pumps of small dimensions which are difficult to use automatically and continuously.

This results in problems of productivity as well as too high cost prices and packaging costs.

In addition, either these pumps comprise O-rings made of elastomer which are detrimental for the product from the olfactive standpoint, in particular when said product is perfumed, or they do not comprise any, and the seal is not sufficient, in particular for very volatile products.

In addition, when these pumps are used in inverted position, i.e. upside down, seal is no longer ensured and leakages of product occur.

The present invention has for its object satisfactorily to solve the technical problems raised by the prior art.

This object is attained, according to the invention, by means of a pump of the type comprising a substantially cylindrical body internally defining a metering chamber of which the lower end is provided with an intake orifice equipped with a valve and whose upper end is provided, on the one hand, with an outlet orifice and is, on the other hand, closed by a piston capable of moving in said chamber, by cooperating with elastic return means outside the chamber, between a support up stop and an end-of-stroke down stop, said piston comprising a central core fast with the lower end of an axial hollow rod whose upper end projects outside the metering chamber and a coaxial sleeve, connected to said rod by an elastic articulation ensuring, on the one hand, a sealed contact with the inner wall of the chamber and defining, on the other hand, with said core, an annular evacuating conduit capable of being opened by displacement of said sleeeve relatively to the core and the upper part of the pump body being closed by a flange of which the inner face, on the one hand, forms the up stop of the piston and the outer face, on the other hand, serves as bottom support for the return means; said flange being provided with an axial bore in which the hollow rod fast with the piston moves, characterized in that said sleeve comprises an upper ring intended to come into sealed engagement in a peripheral groove made on the inner face of said flange.

According to an advantageous characteristic, said sleeve comprises a flared lower skirt whose inner face opposite the core is provided with a peripheral snap ring adapted, when the evacuating conduit is in position of closure, to be in sealed contact with said core.

According to a particular embodiment, said articulation comprises a central collar mounted by radial clamping on the periphery of said axial hollow rod and connected to the sleeve by an elastically deformable distance piece.

According to another variant, the flange is constituted by a central bush provided with a snapping member in the upper part of the body and by a peripheral flange for fixation on the upper raised edge of said body.

According to a specific embodiment, said hollow rod and said core are made in one piece.

According to a first variant, said hollow rod is separated from the core by transverse channels supplied by the evacuating conduit.

According to a second variant, said axial hollow rod is connected, outside the metering chamber, to a spray nozzle tube.

The distance piece of the articulation of the sleeve is preferably disposed substantially opposite the opening of the transverse channels and presents drafts.

The spray nozzle tube preferably bears a peripheral shoulder defining an upper support face for the return means of the piston.

According to another variant, said shoulder extends downwardly by a cylindrical wall moving in guided manner in said central bush of the flange which defines with said wall a housing for said return means.

According to other characteristics, the body comprises an orifice forming vent located, when the piston is in up position, above the lower edge of the sleeve.

Furthermore, it may be provided that said sleeve presents a bevelled end ensuring a sealed scraping surface contact with the inner wall of the metering chamber.

According to yet another variant, the lateral face of the core and the opposite inner face of the sleeve are parallel and inclined with respect to the axis of the pump.

Said core preferably presents a truncated lower part capable of being housed in a cavity of complementary profile made in the lower part of the body, under the level of the down stop of the piston, in order to allow a forced opening of the evacuating conduit at priming.

The pump of the invention presents a very high degree of tightness without using a seal, which renders it compatible from the olfactive standpoint with perfumes and perfumed cosmetic products.

The tightness obtained is such that the pump of the invention may be used upside down without causing any leakage of the product.

The various elements constituting the pump may be assembled in one simple operation, which allows a complete automatization of the manufacturing and packaging steps and leads to productivity gains.

In addition, the return means of the piston are placed outside the metering chamber, which makes it possible to reduce the dimensions of the part of the pump body inside the recipient and to package a larger quantity of product in a recipient of the same volume.

The invention will be more readily understood on reading the following description accompanied by the drawings, in which:

FIG. 1 shows a view in section of an embodiment of the pump of the invention at rest, in position of closure.

Figure 2A:
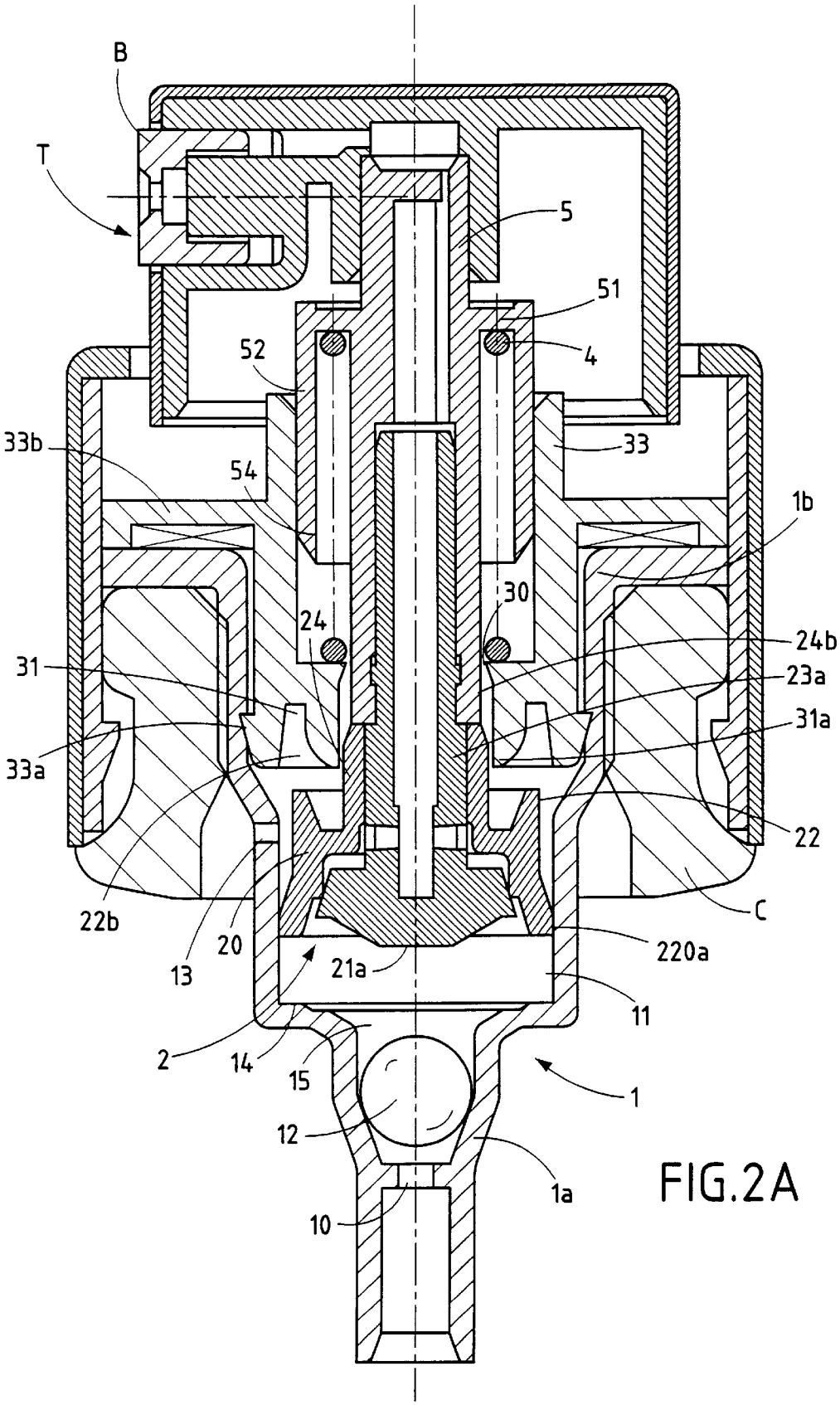
Figure 2B:
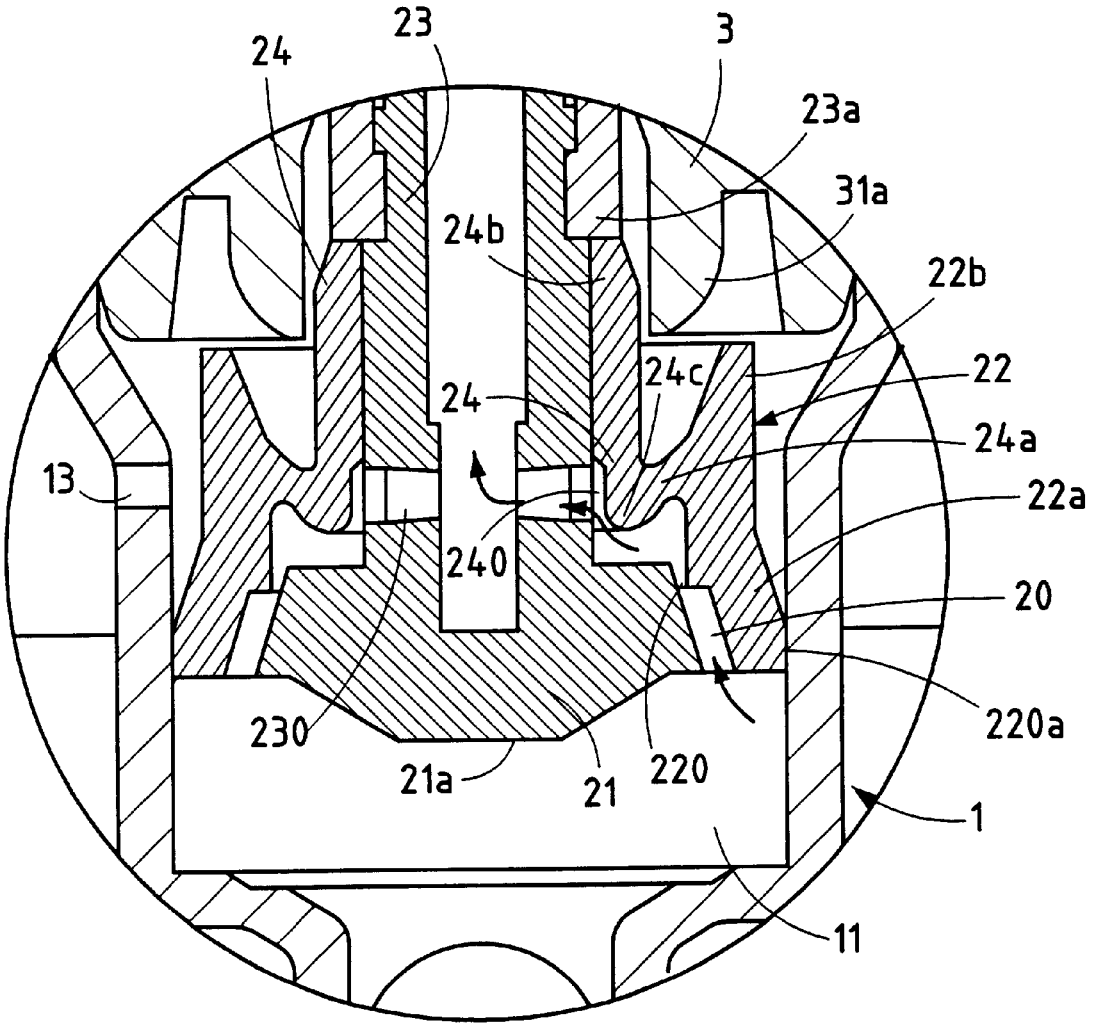

FIGS. 2*a* and 2*b* show views in section respectively complete and in detail of the pump of FIG. 1 in position of opening, during a phase of spraying.

Figure 3:
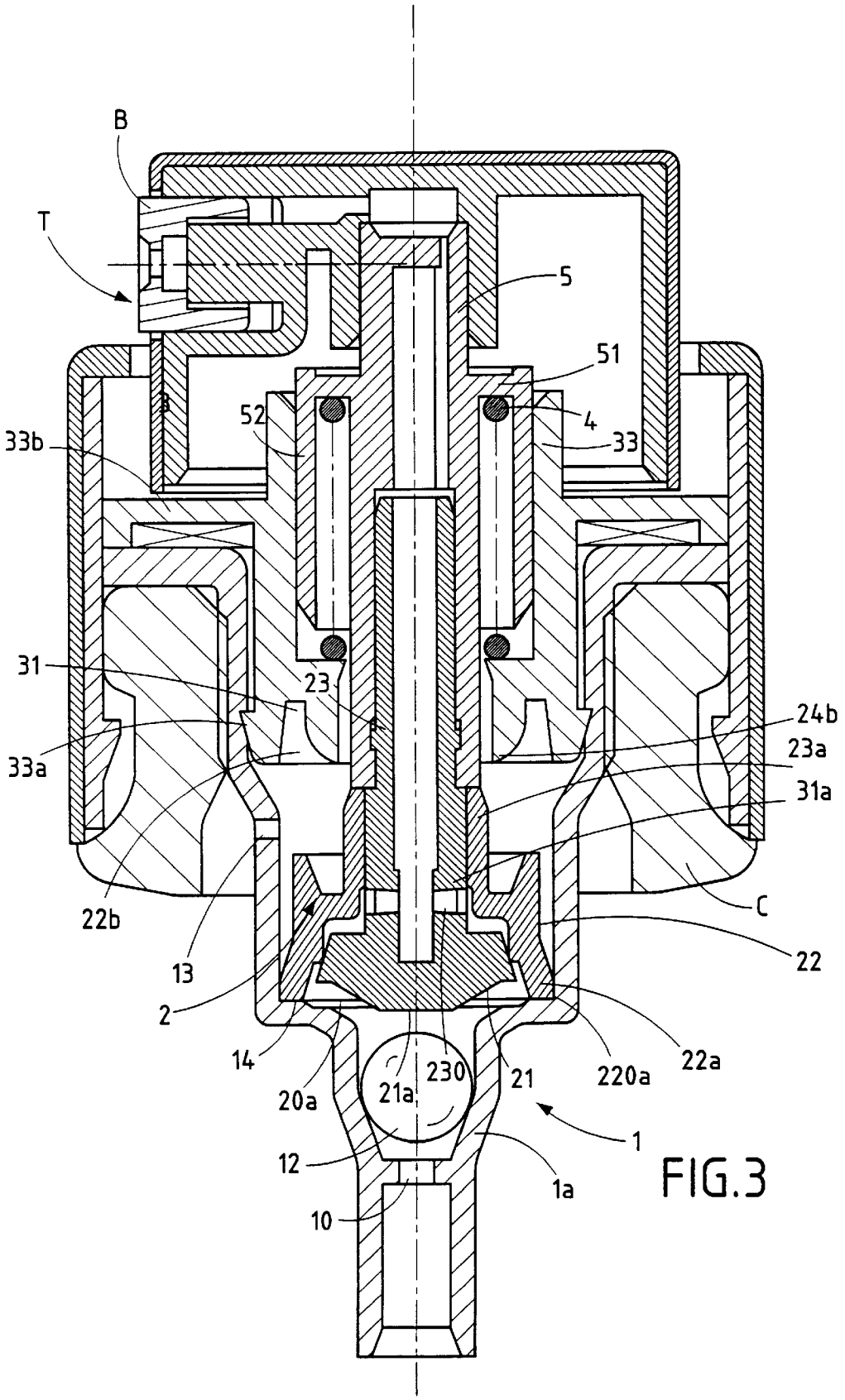

FIG. 3 shows a view in section of the pump of FIG. 1 at the end of spraying.

Figure 4A:
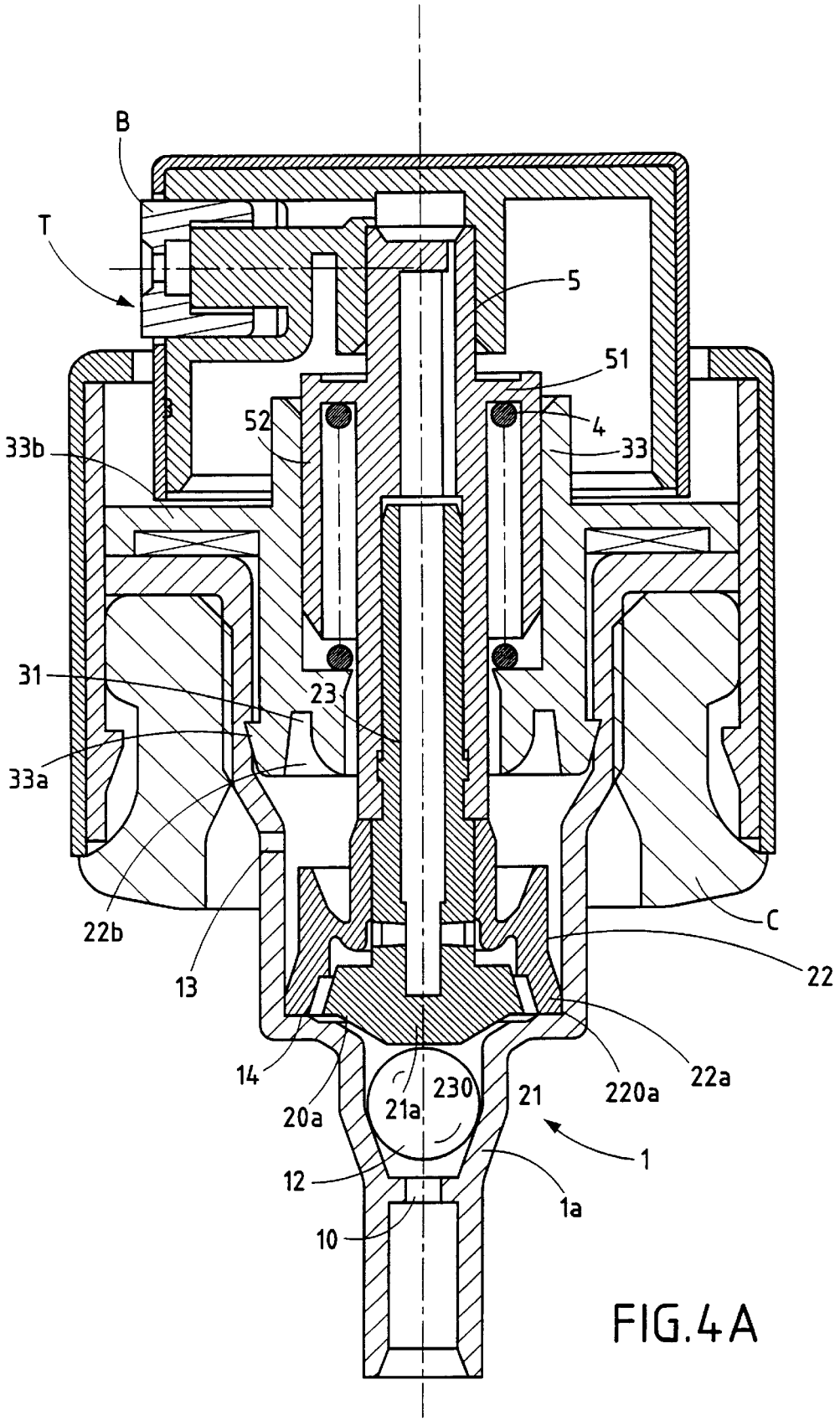
Figure 4B:
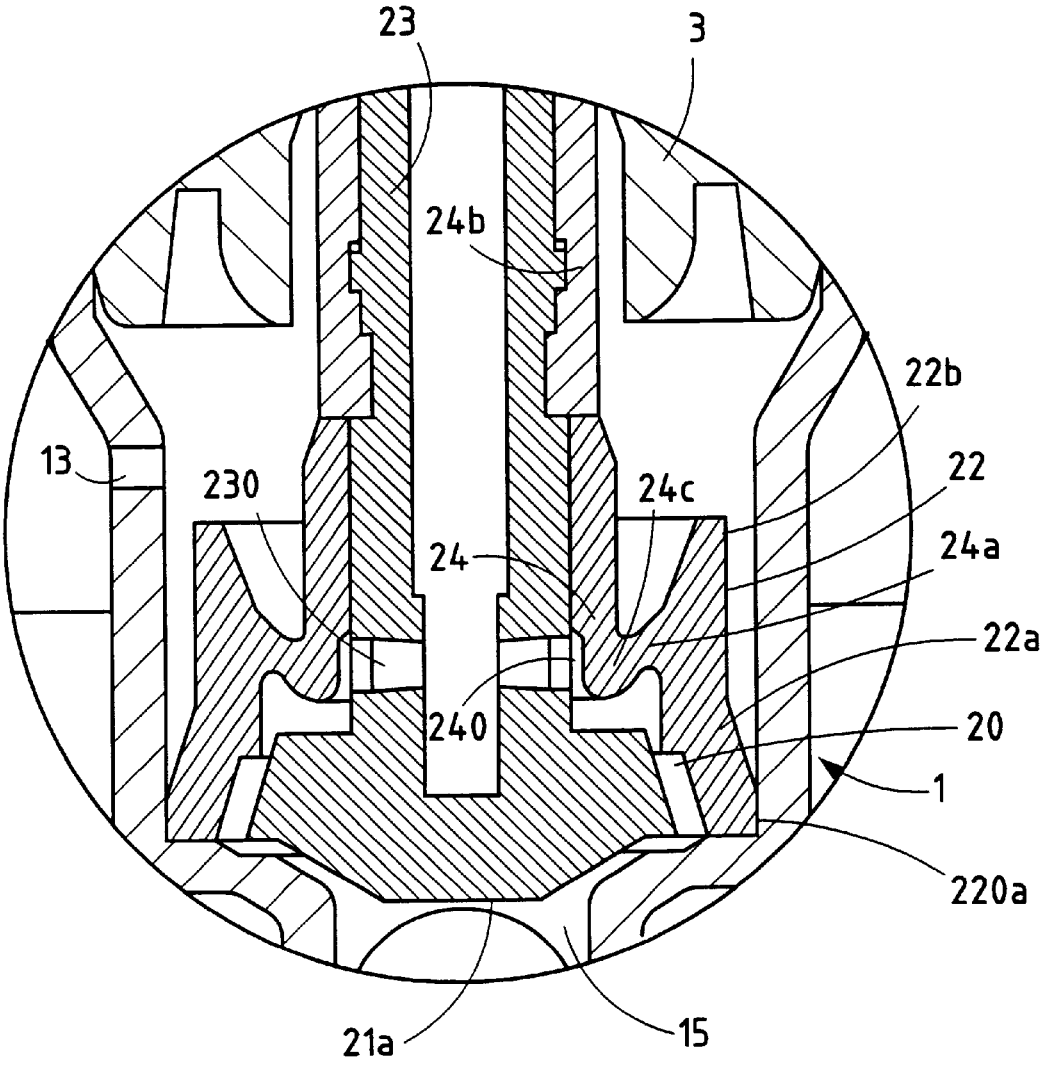

FIGS. 4*a* and 4*b* show views in section respectively complete and in detail of the pump of FIG. 1, in priming phase.

The pump shown in FIG. 1 is intended for diffusing perfumes or cosmetic and pharmaceutical products from a recipient.

This pump comprises a substantially cylindrical body internally defining a metering chamber 11.

The body 1 of the pump is intended to be tightly fixed on the neck C of the recipient.

The lower end 1*a* of the body 1 is provided with an intake orifice 10 equipped with a valve 12, here in the form of a ball.

The upper end 1*b* of the body 1 is made to be open in order to allow the introduction of a piston 2 and is provided with an outlet orifice 20*a*.

The orifice 20*a* opens out in a closable conduit 20 for evacuation of the product from chamber 11.

The piston 2 is capable of moving in the chamber 11 between a rest, or support, up stop and an end-of-stroke, or limit, down stop, being returned into position of rest by a helicoidal spring 4 disposed outside the chamber 11.

The piston 2 comprises a central core 21 fast with the lower end 23*a* of an axial hollow rod 23 of which the upper end 23*b* projects outside the chamber 11.

In the embodiment shown, the rod 23 and the core 21 are made in one piece.

The core 21 is coaxially surrounded by a sleeve 22 made in the form of an added piece and connected to rod 23 via an elastic articulation 24.

According to a variant (not shown) of the core 21, the rod 23 and the sleeve 22 are made in one piece; The sleeve 22 ensures, on the one hand, a sealed contact with the inner wall of the chamber 11 and defines, on the other hand, with the core 21, the annular conduit 20.

The sleeve 22 comprises a flared lower skirt 22*a* of which the inner face, opposite the core 21, is provided with a peripheral snap ring 220. The ring 220 is intended, when the conduit 20 is in position of closure (FIGS. 1 and 3), to be in sealed contact wit the core 21.

The hollow rod 23 is separated from the core 21 by transverse channels 230 supplied via the evacuating conduit 20.

The lateral face of the core 21 and the opposite inner face of the sleeve 22 are parallel and inclined with respect to the axis of the pump.

The articulation 24 comprises a central collar 24*b* mounted by radial clamping on the periphery of the hollow rod 23 above the core 21.

The collar 24*b* is connected to the sleeve 22 by an elastically deformable distance piece 24*a* allowing the relative displacement of the sleeve 22 with respect to the core 21.

The sleeve 22 also comprises an upper ring 22*b* which extends in line with the lower skirt 22*a;* the distance piece 24*a* ensuring separation between the skirt 22*a* and the ring 22*b*.

The upper part of the pump body 1 is closed by snapping a flange 3 whose inner face forms the up stop of the piston 2 and whose outer face serves as lower support for the spring 4.

The flange 3 is constituted by a central bush 33 provided with an axial bore 30 in which the axial hollow rod 23 fast with the piston 2, moves. The collar 24*b* has a height substantially equal to that of the bore 30, and the respective profiles of the upper edges of the bore and of the collar are complementary.

The ring 22*b* of the sleeve 12 is, in the position of rest of the pump shown in FIG. 1, engaged in sealed abutment in a peripheral groove 31 made on the inner face of the flange 3.

The ring 22*b* has an inner face slightly inclined towards the axis of the pump, while its outer lateral face is substantially parallel to this axis.

Similarly, the inner sidewall 31*a* of the groove 31, opposite the inner face of the ring 22*b,* presents a slight curvature towards the axis of the pump in order to ensure a sliding contact of the opposite faces on one another and a guiding of the ring 22*b* in the groove 31 towards the up stop position.

In this latter position, the upper edge of the ring 22*b* is not in contact with the bottom of the groove 31 so as to avoid any deformation of the sleeve 22. However, the inner face of the ring 22*b* is in sealed contact with the inner sidewall 31 of the groove.

Furthermore, the end of the inner sidewall 31*a* of the groove 31 is in abutment, with sealed contact, against the upper face of the distance piece 24. The up stop of the piston 2 corresponds therefore to a double level of tightness with respect to possible infiltrations of product that may occur via the venting orifice 13, located above the lower edge of the skirt 22*a* when the piston 2 is in up stop position.

When the pump is in inverted position, the groove 31 formes a zone of retention making it possible to collect the possible flows of product which penetrate inside the chamber 11 via the orifice 13. The central bush 33 of the flange 3 is provided with a member 33*a* for tight snap in the upper part 1*b* of the body 1 and with a peripheral flange 33*b* for fixation on the upper raised edge of the body 1.

The transverse channels 230 open out laterally on the rod 23 and opposite the bend 24*c* for connection between the collar 24*b* and the distance piece 24*a* of the articulation 24.

However, these channels are never closed by the bend 24*c* due to the presence of drafts 240.

The axial hollow rod 23 is connected, outside the metering chamber 11, to a spray nozzle tube 5, for example by fitting or snapping. The tube 5 bears a peripheral shoulder 51 which defines an upper support face for the spring 4. The shoulder 51 extends downwardly in the direction of the flange 3 by a cylindrical wall 52 moving in guided manner with a slight clearance in the central bush 33 which defines with the wall 52 a housing 54 for the spring 4.

The skirt 22*a* of the sleeve 22 presents a bevelled end with an outer face 220*a* which ensures a sealed surface contact of the piston 2 with the inner wall of the metering chamber 11 during its displacements.

In FIGS. 2*a* and 2*b,* the piston is descending in the chamber 11 under the effect of a manual thrust exerted on the spray nozzle tube 5 via the spray head T.

If the pump is already primed, the chamber 11 is filled with product and the thrust is transmitted by the incompressible liquid product to the walls of the chamber 11 and in particular to the skirt 22*a* of the articulated sleeve 22.

Now, the sleeve 22 is the only mobile element in the chamber 11.

The thrust exerted on the sleeve 22 then provokes its upward displacement along the inner wall of the chamber 11 by elastic deformation of the articulation 24 (cf. FIG. 2*b*).

Such displacement has the result of spacing the peripheral ring 220 apart from the lateral face of the core 21 and thus of opening the annular evacuating conduit 20.

Continuation of the descent of the piston 2 is accompanied by a scraping of the wall of the chamber 11 by the face

220*a* of the end of the skirt 22*a* and brings about the escape of the product via the conduit 20 then successively via the transverse channels 230, the hollow rod 23 and the spray nozzle tube 5 up to the spray nozzle B of the head T.

When the lower edge of the skirt 22*a* comes into contact with the down stop defined by a shoulder 14 in the lower part of the body 1, the whole volume, initially occupied by the product in the chamber 11, has been evacuated, except for the residual volume located in the cavity 15 made in the lower part of the body 1.

At that stage, the spring 4 is compressed and the wall 52 is driven in the housing 54 as shown in FIG. 3.

No thrust effort is exerted any more on the sleeve 22 which then pivots downwardly, being elastically returned by the articulation 24 which resumes its initial shape and position.

The peripheral ring 220 resumes its support on the core 21 and thus closes the conduit 20.

Release of the head T and of the spray nozzle tube 5 is accompanied by the release of the spring 4, the guided exit of the wall 52 via the top of the bush 33 and the rise of the piston 2 in the chamber 11, sucking product in the recipient via the orifice 10 via the valve 12 in open position.

This phase is continued until the piston resumes its position of up stop support where the ring 22*b* of the sleeve 2 is engaged tightly in the groove 31 of the flange 3 (cf. FIG. 1).

FIGS. 4*a* and 4*b* relate to the phase of priming of the pump.

In effect, after the operations of manufacture, assembling and packaging, the recipient R contains product but the metering chamber 11 contains only air.

The first descent of the piston 2 therefore has the effect of compressing the air in the chamber 11. From a determined value of overpressure, the sleeve 22 moves in upward translation and the ring 220 moves apart from the core 21, opening the conduit 20.

The compressed air then escapes to the outside via conduit 20, the channels 230, the rod 23, the tube 5 and the nozzle B.

All the air present in the chamber 11 is evacuated by forced opening of the conduit 20 due to the fact that the core 21 presents a truncated lower part 21*a* capable of being housed in the cavity 15 of complementary profile located beneath the level of the down stop 14 of the piston 2.

The placing of the piston 2 in down stop leaves the conduit 20 open for a short time which corresponds to the time necessary for the cavity 15 to be degassed.

Then, the release of the head T, the release of the spring 4, the closure of the conduit 20 and the rise of the piston 2 create a vacuum in the chamber 11 and ensure its first filling by suction of product in the recipient.

What is claimed is:

1. Pump of the type comprising a substantially cylindrical body (1) internally defining a metering chamber (11) of which the lower end (1*a*) is provided with an intake orifice (10) equipped with a valve (12) and whose upper end is provided, on the one hand, with an outlet orifice and is, on the other hand, closed by a piston (2) capable of moving in said chamber (11), by cooperating with elastic return means (4) outside the chamber (11), between a support up stop and an end-of-stroke down stop, said piston (2) comprising a central core (21) fast with the lower end (23*a*) of an axial hollow rod (23) whose upper end (23*b*) projects outside the metering chamber (11) and a coaxial sleeve (22), connected to said rod (23) by an elastic articulation (24) ensuring, on the one hand, a sealed contact with the inner wall of the chamber (11) and defining, on the other hand, with said core (21), an annular evacuating conduit (20) capable of being opened by displacement of said sleeeve (22) relatively to the core (21), and the upper part of the pump body (1) being closed by a flange (3) of which the inner face, on the one hand, forms the up stop of the piston (2) and the outer face, on the other hand, serves as bottom support for the return means (4); said flange (3) being provided with an axial bore (30) in which the hollow rod (23) fast with the piston moves, characterized in that said sleeve (22) comprises an upper ring (22*b*) intended to come into sealed engagement in a peripheral groove (31) made on the inner face of said flange (3).

2. Pump according to claim 1, characterized in that said sleeve (22) comprises a flared lower skirt (22*a*) whose inner face opposite the core (21) is provided with a peripheral snap ring (220) intended, when the evacuating conduit (20) is in position of closure, to be in sealed contact with said core (21).

3. Pump according to claim 1, characterized in that said articulation (24) comprises a central collar (24*b*) mounted by radial clamping on the periphery of said axial hollow rod (23) and connected to the sleeve (22) by an elastically deformable distance piece (24*a*).

4. Pump according to claim 1, characterized in that the flange (3) is constituted by a central bush (33) provided with a snapping member (33*a*) in the upper part of the body (1) and a peripheral flange (33*b*) for fixation on the upper raised edge of said body (1).

5. Pump according to claim 1, characterized in that said hollow rod (23) and said core (21) are made in one piece.

6. Pump according to claim 1, characterized in that said hollow rod (23) is separated from the core (21) by transverse channels (230) supplied via the evacuating conduit (20).

7. Pump according to claim 1, characterized in that said axial hollow rod (23) is connected, outside the metering chamber (11), to a spray nozzle tube (5).

8. Pump according to claim 7, characterized in that the spray nozzle tube (5) bears a peripheral shoulder (51) defining an upper support face for the return means (4) of the piston (2).

9. Pump according to claim 4, characterized in that said shoulder (51) extends downwardly by a cylindrical wall (52) moving in guided manner in said central bush (33) of the flange (3) which defines with said wall (52) a housing (54) for said return means (4).

10. Pump according to claim 1, characterized in that the body (1) comprises an orifice (13) forming vent located, when the piston (2) is in up position, above the lower edge of the sleeve (22).

11. Pump according to claim 1, characterized in that said sleeve (22) presents a bevelled end (220*a*) ensuring a sealed scraping surface contact with the inner wall of the metering chamber (11).

12. Pump according to claim 1, characterized in that the lateral face of the core (21) and the opposite inner face of the sleeve (22) are parallel and inclined with respect to the axis of the pump.

13. Pump according to claim 1, characterized in that said core (21) presents a truncated lower part (21*a*) capable of being housed in a cavity (15) of complementary profile made in the lower part (1*a*) of the body (1) under the level of the down stop of the piston (2) to allow a forced opening of the evacuating conduit (20) at priming.

14. Pump according to claim 3, characterized in that the distance piece (24*a*) of the articulation of the sleeve (22) is disposed substantially opposite the opening of the transverse channels (230) and comprises drafts (240).

* * * * *